United States Patent [19]

Chang et al.

[11] 4,133,124

[45] Jan. 9, 1979

[54] DISPLAY DEVICE

[76] Inventors: Karl Chang; Dora D. J. Chang, both of 2449 Sonoma St., Honolulu, Hi. 96822

[21] Appl. No.: 715,490

[22] Filed: Aug. 18, 1976

Related U.S. Application Data

[63] Continuation-in-part of Ser. No. 647,335, Jan. 8, 1976, abandoned.

[51] Int. Cl.[2] ..... G09F 13/24

[52] U.S. Cl. ..... 40/408; 362/811

[58] Field of Search ..... 40/106.21, 106.22, 106.23; 240/10 A; 362/811

[56] References Cited

U.S. PATENT DOCUMENTS

| | | | |
|---|---|---|---|
| 814,889 | 3/1906 | Tacy | 40/106.23 |
| 1,080,340 | 12/1913 | Heissenbuttel | 40/106.22 |
| 1,856,098 | 5/1932 | Green | 40/106.21 |
| 2,133,499 | 10/1938 | Dolan | 40/106.23 |
| 3,101,564 | 8/1963 | Stoessel | 40/106.22 |
| 3,464,132 | 9/1969 | Matisse | 40/106.21 |
| 3,541,705 | 11/1970 | Nelson | 40/106.21 |

FOREIGN PATENT DOCUMENTS

| | | | |
|---|---|---|---|
| 357656 | 10/1931 | United Kingdom | 240/10 A |

*Primary Examiner*—Samuel W. Engle
*Assistant Examiner*—Ralph Palo
*Attorney, Agent, or Firm*—Townsend and Townsend

[57] ABSTRACT

Diffused light is projected onto a supported thin film in the form of a truncated sphere. The device has a light source disposed at the bottom end of a housing constructed of a light shielding material, and a diffuser plate at the top end of the housing to emit light into the truncated sphere. In one embodiment the plate carries a layer of liquid soap from which a bubble is blown. The housing may also carry a clear glass dome over its top end adjacent which the thin film is supported. Decorative interference patterns of luxuriant colors result.

3 Claims, 5 Drawing Figures

DISPLAY DEVICE

The present application is a continuation-in-part of my copending patent application entitled "Display Device", filed Jan. 8, 1976, Ser. No. 647,335; now abandoned in favor of the present application.

BACKGROUND OF THE INVENTION

The present invention relates in general to a display device and is more particularly concerned with a device for displaying interference patterns which are created by projecting light onto or through a thin film such as a liquid soap film. The concepts of this invention may be embodied in a bubble-blowing apparatus wherein the interference patterns are observed through the bubble.

U.S. Pat. Nos. 1,556,170; 3,325,935; 3,387,396; 3,570,156; and 1,776,476 show various types of lamp display devices. U.S. Pat. No. 814,889 shows a device for automatically blowing bubbles. However, none of these patents suggests the concept of the present invention of displaying interference patterns of substantial brightness and color change.

Accordingly, one object of the present invention is to provide a means and method of displaying interference patterns by projecting light onto or through a thin film. This thin film may be a liquid soap film, which is preferably a soap bubble blown to the shape of a truncated sphere.

A further object of the present invention is to provide a display device constructed in the form of a housing and including means for supporting a thin film which is preferably a liquid film supported in the form of a truncated sphere. Light projected through the truncated portion of the sphere rebounds to and out the sphere sides, producing luxuriant interference patterns rich in color.

A further object of the present invention is to provide a combination display device and bubble-blowing apparatus.

SUMMARY OF THE INVENTION

To accomplish the foregoing and other objects of this invention there is provided a device for displaying interference patterns created by projecting light onto or through a thin liquid or solid film which preferably is a soap film blown to the shape of a truncated sphere. The device comprises a housing constructed of an opaque material. This housing is essentially completely enclosed with the exception of an opening. A light source is disposed in the housing at a position generally remote from the opening. The truncated sphere at its truncated portion is supported on the housing at or adjacent the opening. If the thin film is a soap film. then this can be supported on a flat plate having a peripheral lip with the air forming the bubble being inside. A diffuser plate is disposed across the top opening of the housing. This plate serves the dual function of diffusing the light from the lamp and also supporting the thin film. A bubble-blowing mechanism may be associated with the housing for blowing one or more bubbles which may cover the entire diffuser plate. In an alternate embodiment, a clear glass hemisphere extends over the top of the housing and diffuser plate and the heat generated by the light source causes the fluid on top of the diffuser plate to evaporate and form a thin film on the inside surface of the hemisphere. Light projected from the housing produces decorative interference patterns of luxuriant color.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
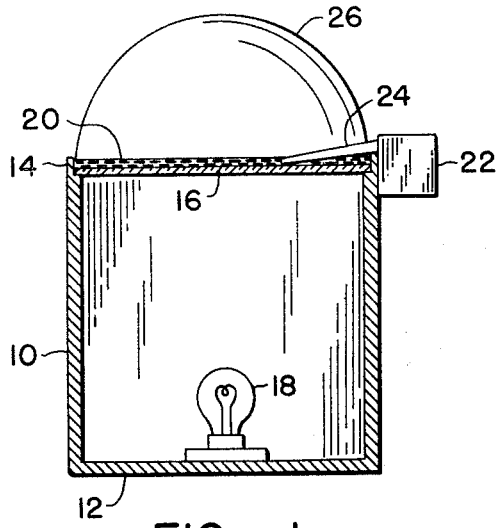
FIG. 1 is a cross-sectional view through one embodiment of a display device of this invention also having bubble-blowing means associated therewith.

FIG. 1 shows one embodiment of the device of this invention comprising a cylindrical housing 10 which is preferably constructed of an opaque material. This housing has a base 12 and a top annular lip 14 in which sits a disk-shaped diffuser plate 16. A source of light is also disposed in the housing and it is shown as lamp 18 suitably supported from the base 12 of the housing.

A layer 20 of liquid soap or other liquid capable of being blown into a thin film bubble is disposed over the diffuser plate 16. The plate 16 may be liquid sealed to the lip 14 with the lip 14 serving as a retaining means for the liquid 20.

FIG. 1 also shows a blowing apparatus 22 which may comprise a blower and a source of power. From the apparatus 22 there is shown a tube 24 through which the forced air flows. The tube 24 is at least partially submerged in the liquid 20 and when the device 22 is operated, a bubble such as the bubble 26 shown in FIG. 1 may be formed. The soapy water bubble 26 which has a form substantially that of a truncated sphere is essentially a thin film which, when illuminated by the light projecting through the diffuser plate 16, demonstrates interference patterns of remarkable brightness and color change. The device 22 may be operated automatically or manually.

Figure 2:
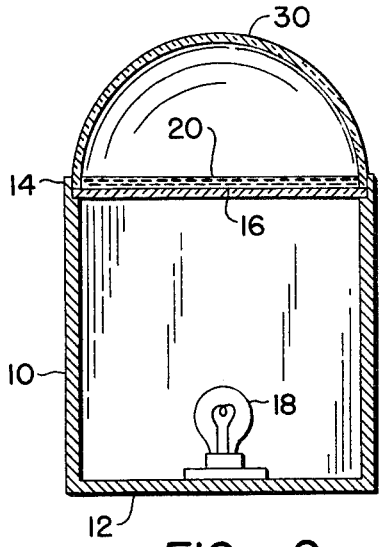
FIG. 2 is a cross-sectional view similar to that shown in FIG. 1 but for a different embodiment.

In FIG. 2, like reference characters are used to identify parts previously shown in FIG. 1. Thus, there is shown the cylindrical housing 10, the lamp 18, and the diffuser plate 16. In this embodiment, there is added a clear glass hemisphere 30 which may be tightly sealed at its edge to the top edge defining the housing. In FIG. 2, the hemisphere is shown disposed on the retaining lip 14. There may be provided a liquid-tight seal between the hemisphere 30 and the housing 10. In the embodiment of FIG. 2, a fluid such as water, hydrocarbons, or fluorocarbons is deposited on the plate 16. Because of the heat created from the lamp 18, this fluid is evaporated and condenses on the inner surface of the hemisphere 30. This action creates interference patterns on the inside of the glass hemisphere. With this second embodiment, it is preferred that the fluid have an index of refraction different from both the material comprising the hemisphere 30, which may be of glass or plastic, and also different from the index of refraction of air. By the proper selection of the lamp and the selection of other components and the size thereof, proper evaporation and condensation can be obtained. In FIG. 2, the dome 30 is preferably coated with an anti-reflective coating on its outside surface.

In the embodiment shown in FIG. 1, multiple bubbles can also be obtained. The liquid on the surface of plate 16 serves to cool and lubricate the path of the bubble's edge as the bubble is being blown. Thus, it is quite easy to form a bubble as shown in FIG. 1.

OPERATION

Figure 3:
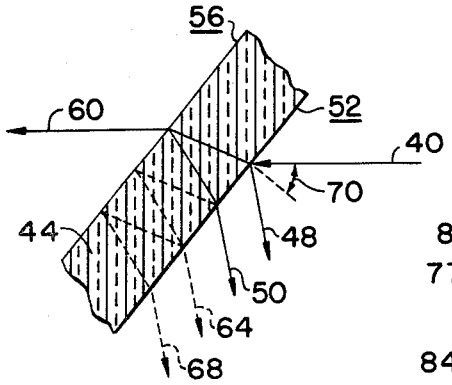
FIG. 3 shows the relationship between a light ray incident upon a thin film and the two reflected rays that give rise to the interference phenomenon.

FIG. 3 shows how the phenomenon of interference arises when a thin film is illuminated. A light ray 40 incident on a film 44 of transparent material gives rise to two singularly reflected rays 48 and 50. These rays, the results of reflection from the front and rear surfaces 52 and 56 of the film, are of nearly equal intensity to one another and are considerably less intense than the incident ray 40 and transmitted ray 60. Rays 64 and 68 resulting from multiple reflections inside the film are of negligible intensity.

If the film is thin enough, the reflected rays 48 and 50 will interfere with each other. Depending on the wave length of the incident light and the optical path difference of the reflected rays 48 and 50 (itself dependent on the angle of incidence 70, and the thickness and refractive index of the film), the two rays 48 and 50 will tend to reinforce each other or cancel one another.

If a mixture of wave lengths is incident, the reflected light will be a different mixture since some of the constituents will have cancelled while others will have reinforced. Thus, if the incident light is white light (a mixture of all colors), the reflected light will appear as one of a great variety of colors.

Figure 4:
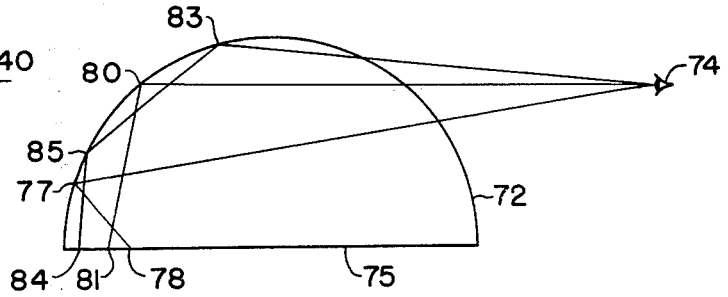
FIG. 4 shows a viewer looking at different portions of a bubble.

FIG. 4 shows the manner of viewing a soap bubble displayed on the device. Upon looking at the bubble 72 displayed on the device, the viewer 74 sees the various areas of the diffuse light source 75 reflected in various areas of the bubble that are concave toward the viewer. These concave areas of the bubble function in the manner of a spherical mirror. Since the bubble is a thin film, the reflected light shows the interference phenomena described in connection with FIG. 3. The parts of the bubble surface that are convex toward the viewer serve merely as transparent windows through which the reflected light passes.

For example, when the eye is directed at the portion of the bubble at 77, the reflection of the portion of the light source at 78 is seen. Similarly, the portion of the light source at 81 is seen reflected in the portion of the bubble at 80. Since different angles of incidence are involved, the different portions of the bubble will in general be seen as different colors. A similar variation occurs as the viewer changes position.

Multiple reflections also occur. Thus, the viewer looking at the portion of the bubble at 83 sees the reflection of the portion of the light source at 84, but the geometry is such that the light has reflected off the portion of the bubble at 85 as well. The normal diminution of intensity due to multiple reflections is offset by the increase in the coefficient of reflection at the glancing angles involved.

Using a thin film in the form of a bubble is advantageous in that the film is self-supporting and provides a wide range of incidence angles. Illuminating the bubble from below allows for close proximity between the light source and the thin film. This, in conjunction with the concavity toward the light source, results in a relatively complete illumination of the film from most viewing positions.

The rich panoply of colors is further enhanced by the thickness variations of the bubble wall itself. Due to gravity, the wall tends to get thicker toward the bottom. In some configurations, this can increase the range of optical path differences (and hence colors). In addition, there are many local irregularities in the wall thickness. Thus, a swirling abstract guality is lent to the otherwise precise and intricate geometrical pattern.

Since the wall thickness varies temporally as well as spatially as described above, the observed pattern is a dynamic one the boundaries and colors continually shifting in a most intriguing manner.

The annular lip serves four functions.

First, it forms a reservoir which holds the liquid from which the bubble is blown, thus providing liquid for the bubble, and a lubricating surface to facilitate the blowing of large bubbles.

Second, it prevents the bubble from wandering, thereby keeping it positioned over the light source.

Third, it keeps the diffuse light within the truncated bubble.

Fourth, it acts as a stop to shield the viewer's eye from the diffuse light source which is much more intense than the interference patterns being observed.

Figure 5:
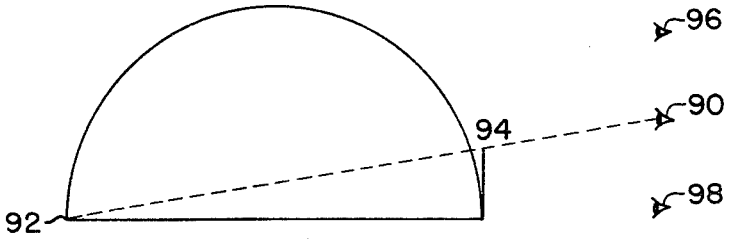
FIG. 5 shows the function of the annular lip as a light stop.

Regarding the fourth function above, reference is made to FIG. 5. The viewer 90 who keeps his eye just at the line between the farthest lowest point 92 of the bubble and the highest nearest point 94 on the lip will see all of the far bubble wall (the reflecting wall), but none of the light source. The viewer 96 who keeps his eye higher will see part of the light source. The viewer 98 who keeps his eye below the line will miss part of the bubble. This shielding function is important since the present of the light source in the field of view causes the pupil of the eye to contract, resulting in an apparently less intense and brilliant interference pattern than is otherwise observed.

We claim:

1. A device for displaying to a viewer situated to the side of the device interference patterns created by reflection of light from a thin film comprising: a light source; a housing constructed of opaque material surrounding the light source, the housing having an opening at its top whereby light from the light source emanates from the opening; a translucent plate commensurate in size with the opening in the housing; means for supporting the translucent plate over the opening; and a lip surrounding the translucent plate to define a reservoir having the translucent plate as a bottom and the lip as its sides to contain a bubble-producing liquid, the reservoir having a depth small compared to its surface dimensions; whereby a bubble blown from the liquid forms a thin film in the form of the truncated sphere with the truncation disposed over the opening, the thin film having first and second reflective curved interfaces at a separation sufficiently small to produce interference effects, a portion of the thin film being concave towards the viewer, such that light directed from the opening reflects from the interfaces to the eyes of the viewer, causing interference effects between the light reflected from the first interface and the light reflected from the second interface.

2. The invention of claim 1 wherein the translucent plate and the peripheral lips are integral.

3. A device for displaying interference patterns created by reflecting light from a thin film to the eyes of a viewer at the side of the device comprising: a light source; a housing surrounding the light source and having an opening at its top; a translucent plate having a size commensurate with the opening; means for supporting the translucent plate over the opening whereby light emanating from the opening illuminates the translucent plate; a lip surrounding the periphery of the translucent plate to define a reservoir having a depth small compared to its surface dimensions; a volume of bubble-generating liquid within the reservoir; means for producing from the liquid a bubble which provides a thin film in a form substantially that of a truncated sphere with the truncation of the sphere disposed over the opening, the thin film having first and second interfaces defining a thickness sufficiently small to produce interference effects such that light passing upward from the illuminated translucent plate to the bubble reflects from the concave interfaces of the film to the eyes of the viewer, causing interference effects between the light reflected from the first interface and the light reflected from the second interface.

* * * * *